United States Patent [19]

Scott

[11] Patent Number: 4,903,661

[45] Date of Patent: Feb. 27, 1990

[54] FUEL INJECTION PUMPING APPARATUS

[75] Inventor: Robert H. Scott, Lordswood Chatham, England

[73] Assignee: Lucas Industries Public Limited Company, Birmingham, United Kingdom

[21] Appl. No.: 227,655

[22] Filed: Aug. 3, 1988

[30] Foreign Application Priority Data

Aug. 8, 1987 [GB] United Kingdom ..... 8718853

[51] Int. Cl.[4] ..... F02M 39/00

[52] U.S. Cl. ..... 123/383; 123/373; 123/387; 123/374

[58] Field of Search ..... 123/382, 383, 385, 386, 123/387, 450, 373, 374

[56] References Cited

U.S. PATENT DOCUMENTS

| | | | |
|---|---|---|---|
| 3,960,127 | 6/1976 | Vuaille | 123/383 |
| 4,085,724 | 4/1978 | Djordjeuic | 123/382 |
| 4,120,275 | 10/1978 | Isobe et al. . | |
| 4,227,504 | 10/1980 | Ritter | 123/383 |
| 4,308,834 | 1/1982 | Eheim | 123/383 |
| 4,362,140 | 12/1982 | Jefferson | 123/366 |
| 4,380,223 | 4/1983 | Jefferson | 123/383 |
| 4,432,704 | 2/1984 | Matzen | 123/374 |
| 4,493,617 | 1/1985 | Brady | 123/504 |
| 4,664,081 | 5/1987 | Eheim | 123/383 |

FOREIGN PATENT DOCUMENTS

| | | | |
|---|---|---|---|
| 4821864 | 4/1938 | United Kingdom | 123/383 |

*Primary Examiner*—Carl Stuart Miller

*Attorney, Agent, or Firm*—Balogh, Osann, Kramer, Dvorak, Genova & Traub

[57] ABSTRACT

A fuel pumping apparatus for supplying fuel to an engine has a high pressure pump which includes a component movable to determine the maximum amount of fuel which can be supplied to the engine. The component is biased by a spring to a minimum fuel position and to adjust the setting of the component there is provided a three armed lever one arm of which is coupled to the component. The other two arms are coupled to engine operating parameter responsive devices. In the example the device is a piston which is spring loaded and is responsive to the output pressure of a low pressure fuel pump and the device includes a diaphragm which is subjected to the air inlet manifold pressure.

4 Claims, 3 Drawing Sheets

FUEL INJECTION PUMPING APPARATUS

This invention relates to a fuel injection pumping apparatus for supplying fuel to a compression ignition engine and of the kind comprising a high pressure pump operable in timed relationship with the engine, means including a low pressure pump for supplying fuel to the high pressure pump and a component forming part of the high pressure pump which is adjustable to determine the maximum amount of fuel which can be supplied by the high pressure pump.

In one form of apparatus of the aforesaid kind the high pressure pump comprises a plunger which is located within a transverse bore formed in a rotary distributor member which is driven in timed relationship with the associated engine. The plunger is moved outwardly by fuel supplied to the bore and inwardly to deliver fuel through an outlet to the associated engine, by a cam lobe formed on the internal peripheral surface of an annular cam. The aforesaid component comprises a stop ring which is angularly adjustable about the axis of rotation of the distributor member and which defines an internal stop surface which limits the outward movement of the plunger and thereby the amount of fuel which can flow into the bore for subsequent delivery to the associated engine.

It is known to provide such apparatus in a form in which what is known the art as "torque control" is obtained. Essentially this means the modification of the maximum amount of fuel which can be supplied by the apparatus in accordance with the engine speed. Usually the effect of torque control is to reduce the maximum amount of fuel which can be supplied by the apparatus as the engine speed approaches its allowed maximum value. However, other adjustments of the maximum fuel quantity may also be required in accordance with a varying engine operating parameter. For example in a turbo supercharged engine it is desirable to be able to adjust the fuel quantity in accordance with the air pressure in the engine air inlet manifold so that when the air pressure is low the maximum amount of fuel which can be supplied is reduced as compared with the situation when the turbo supercharger is in full operation. In another example it may be necessary to provide additional torque control in another part of the engine speed range.

The object of the present invention is to provide an apparatus of the kind specified in a simple and convenient form.

According to the invention an apparatus of the kind specified comprises a three arm pivotal lever, the first and second arms being operatively connected to first and second engine operating parameter responsive devices which impart pivotal movement to the lever in response to a change in the engine operating parameter to which they are responsive, the third arm being connected to said component.

Figure 1:
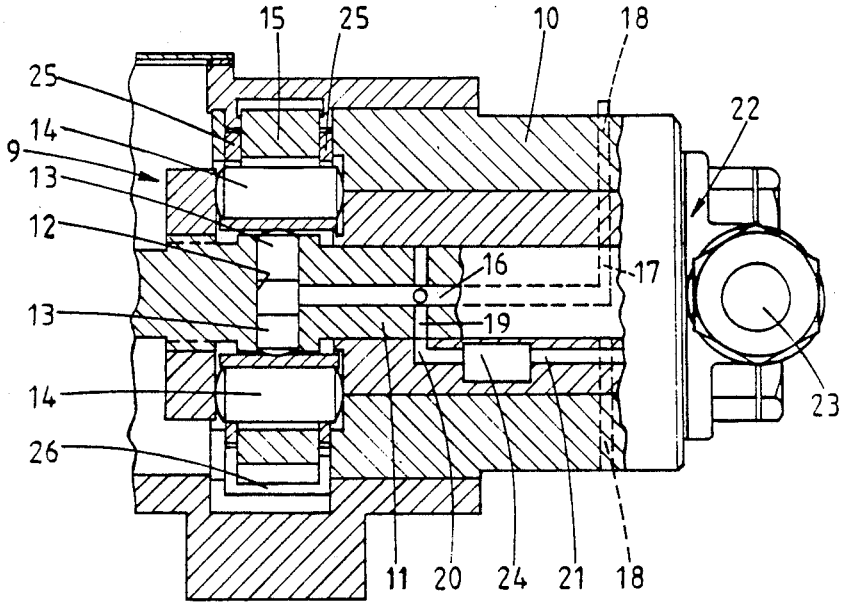
FIG. 1 is a diagrammatic sectional side elevation of one example of a pump.

Referring to FIG. 1 of the drawings the apparatus comprises a body part 10 in which is journalled a rotary cylindrical distributor member 11 in which is formed a transversely extending bore 12. The distributor member in use is driven in timed relationship with an associated engine, the distributor member for this purpose being coupled to a drive shaft not shown.

Located in the bore is a pair of pumping plungers 13 at the outer ends of which are located cam followers each of which includes a roller 14. The rollers are engaged by cam lobes formed on the internal peripheral surface of an annular cam ring 15 which is located within the body part and which for the purpose of timing adjustment, may be angularly adjustable within the body part. The plungers and cam lobes form a high pressure pump 9.

The portion of the bore lying intermediate the plungers 13, communicates with a passage 16 extending longitudinally within the distributor member and at one point the passage 16 communicates with a delivery passage 17 which is positioned to register in turn with a plurality of outlet ports 18 formed in the body part, the outlets in use being connected to the injection nozzles of the associated engine respectively.

At another point the longitudinal passage 16 communicates with a plurality of inlet passages 19 which are positioned to register in turn with an inlet port 20 formed in the body part and connected to the outlet 21 of a low pressure fuel supply pump 22 which has an inlet 23. The communication of the inlet port 20 with an inlet passage 19 occurs during the time when the plungers are allowed to move outwardly by the cam lobes and the quantity of fuel which is supplied to the bore during this period is controlled by a control device 24 which may for example be an adjustable throttle. As the distributor member continues to rotate the inlet passage 19 moves out of register with the inlet port 20 and the delivery passage 17 moves into register with an outlet 18 to allow fuel displaced during the inward movement of the plungers to flow to the appropriate outlet.

In order to control the maximum amount of fuel which can be supplied by the pump to the associated engine, a pair of stop rings 25 is provided, these being positioned on the opposite sides of the cam ring 15 and being mounted for angular adjustment within the body part. The internal surfaces of the stop rings are shaped to define stop surfaces for engagement by the rollers during outward movement of the plungers. The extent of outward movement of the plungers and therefore the maximum amount of fuel which can be supplied to the associated engine is determined by the angular setting of the stop rings.

Figure 2:
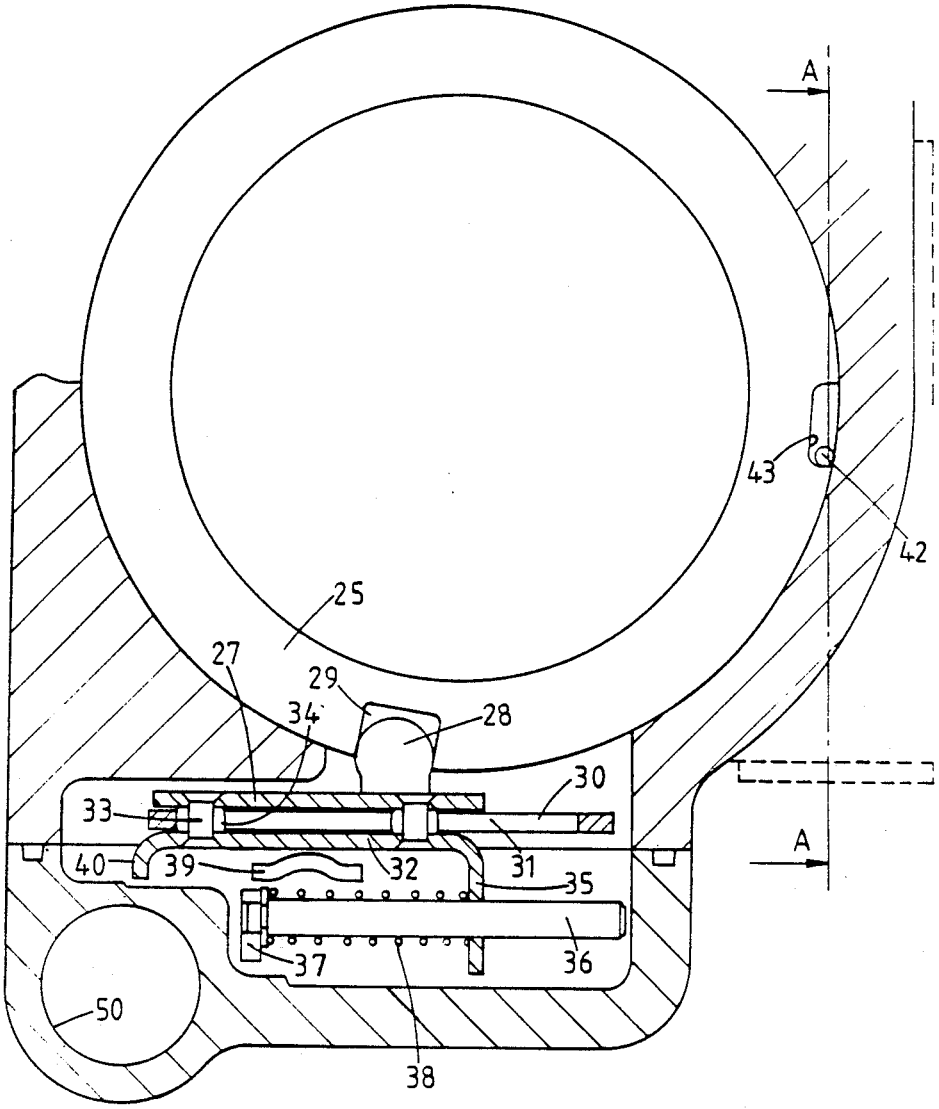
FIG. 2 is a section to an enlarged scale of part of the pump shown in FIG. 1.

The stop rings are connected together so that they move angularly in unison, by means of a saddle member 26 which, as shown in FIG. 2, includes a base section 27 upstanding from which are a pair of spaced tongues 28 which engage within slots 29 respectively formed in the stop rings 25. The saddle member is located on one side of a support plate 30 which is secured within the body part and which is provided with a slot 31. On the opposite side of the support plate 30 is a generally U-shaped member 32, the U-shaped member and the base section of the saddle member being secured together by rivets 33, there being located about each rivet, spacers 34 which slide in the slot 31.

One limb 35 of the U-shaped member is provided with an aperture through which extends a spring locating rod 36 the rod being carried on a support 37 secured within the body part. Interposed between the support 37 and the limb 35 is a spring 38 the effect of which is to bias the saddle member and therefore the stop rings, towards a position to reduce the maximum amount of fuel which can be supplied to the associated engine. A stop means 39 is provided for engagement with the other limb 40 of the member 32 to determine the movement of the saddle member under the action of the spring 38 and the stop means forms part of a device responsive to an engine operating parameter and which will be explained.

For the purpose of starting the associated engine an excess of fuel must be supplied, the excess quantity being greater than the normal maximum quantity of fuel. In order to move the stop rings to permit an excess of fuel to be supplied, a pin 42 movable in a slot 43 is provided the pin being biased by means of a spring which is stronger than the spring 38. Associated with the pin is a fluid pressure operable piston (not shown) responsive to the outlet pressure of the low pressure pump 22 and which moves the pin against the action of the spring to allow the stop plates to move to the normal maximum fuel position as determined by the stop 39.

Figure 3:
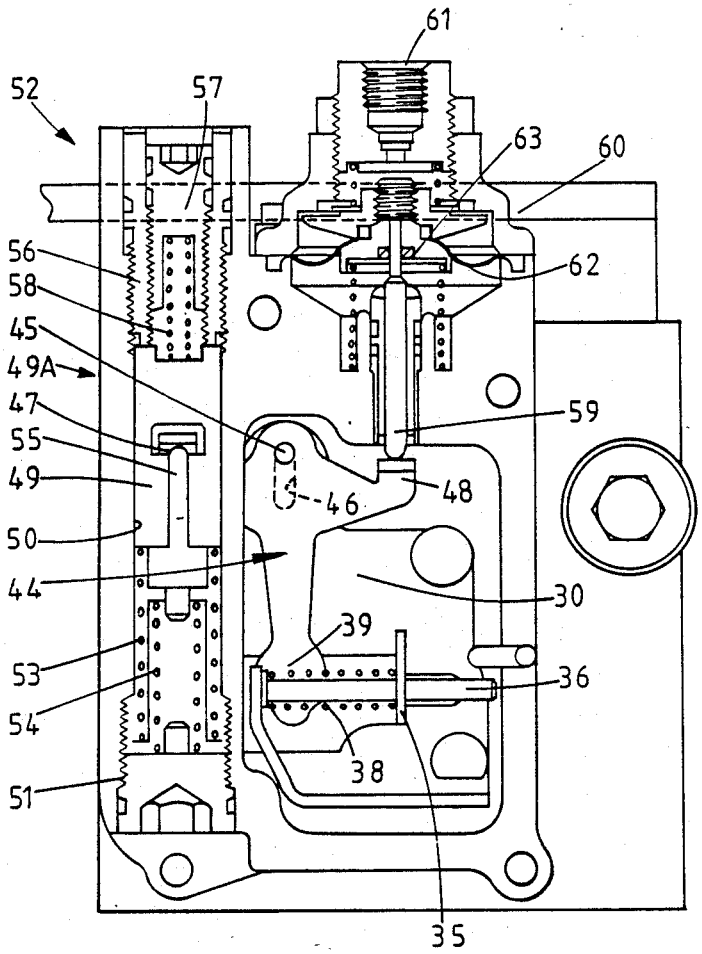
FIG. 3 is an inverted plan view of a part of the apparatus not seen in FIG. 1.

With reference to FIG. 3, the stop means 39 is seen to be one end of the one arm of a three armed lever 44 which carries a pivot pin 45 slidable in an elongated slot 46 in the support plate 30. The lever 44 is of "T" shaped form and the two other arms 47, 48 are of equal length and each terminate in an upstanding tang.

In the case of the arm 47 its tang extends within a transverse opening formed in a piston 49 located within a cylinder 50. The piston forms part of a first engine operating parameter responsive device 49A. The ends of the cylinder are closed by plugs 51, 52, the plug 51 forming an abutment for a spring 54 interposed between the plug and a flanged tubular abutment against which bears a further spring 53 the other end of which engages the piston 49. A pin 55 is fixed in a bore in the piston and terminates in a spherical end in the opening therein. The pin external of the piston defines an enlarged portion about which is located the spring 53 and a reduced portion which guides the adjacent end of the tubular abutment and the spring 54. The plug 52 is formed in two parts the outer part 56 forming an adjustable stop for the piston 49 and the inner part 57 forming an adjustable abutment for a coiled spring 58 which acts on the piston in opposition to the springs 53, 54. A passage (not shown) is provided to allow fuel under pressure from the outlet of the supply pump 22 to act on the face of the piston 49 engaged by the spring 58.

The tang on the arm 48 of the lever 44 is engaged by the spherical end of a push rod 59 which is operatively connected to a pressure responsive device 60 which includes an inlet 61. In the example the inlet 61 is an air inlet which in use, is connected to the air inlet manifold of the associated engine which in this case is a turbo supercharged engine. The device includes a diaphragm 62 of annular form the outer peripheral rim of which is trapped between two parts of the housing of the apparatus. The inner peripheral rim of the diaphragm is sealed to a resiliently loaded carrier 63 which when the pressure of air in the inlet increases, urges the push rod 59 downwardly as seen in the drawing. FIGS. 2 and 3 show the parts in the position which they adopt for the purpose of excess fuel supply.

The axes of movement of the pin 55 and the rod 59 are parallel to each other and to the slot 46, the slot 46 being disposed midway between said axes.

In operation, and ignoring for the moment the pressure responsive device 60, with an increase in the output pressure of the low pressure pump and when the preloading of the springs 53, 54 is overcome, the piston 49 will move and allow anti-clockwise movement of the lever 44 under the action of the spring 38. This allows the spring 38 to move the stop plates to reduce the maximum amount of fuel which can be supplied to the engine thereby providing torque control. The spring 58 and the inner part 57 of the plug 52 are provided for the purpose of adjusting the fuel pressure and therefore the engine speed, at which the piston 49 starts to move. During the movement of the piston the pin 45 slides along the slot 46 and the lever pivots about the spherical end of the push rod 59.

In like manner when the air pressure in the inlet manifold of the engine increases the diaphragm 62 will cause the push rod 59 to move downwardly thereby causing movement of the lever in the clockwise direction. This movement of the lever moves the U shaped member 32 against the action of the spring 38 and the stop plates are moved to increase the maximum amount of fuel which can be supplied to the associated engine. The lever in this case pivots about its point of contact with the spherical end of pin 55 with some sliding therebetween.

In practice the lever moves under the influence of both the piston 49 and also the pressure responsive device 60 in response to changes of engine speed and the air pressure in the air inlet manifold. If the distance between the lines of action of the piston and the push rod is made equal to the length of the arm 39 as measured from the pin 45, the ratio of 1:1 will be obtained for both air pressure and speed changes as compared with the movement of the saddle member 26.

In the example increases in the engine speed and the inlet manifold pressure result in movement of the lever 44 in the opposite direction. In some engine installations for example normally aspirated engines the pressure responsive device may be replaced by a fuel pressure responsive device which modifies the maximum fuel quantity at a lower engine speed. It is also possible to reverse the piston 49 and the associated springs in the cylinder 50.

I claim:

1. A fuel injection pumping apparatus for supplying fuel to a compression ignition engine comprising a high pressure pump operable in timed relationship with the engine, means including a low pressure pump for supplying fuel to the high pressure pump, a component forming part of the high pressure pump which is adjustable to determine the maximum amount of fuel which can e supplied by the high pressure pump to the engine, comprising a single three arm pivotal lever having a first arm, a second arm, and tangs disposed at the ends of said first and second arms, first and second engine operating parameter responsive devices operatively connected to said first and second arms, respectively, said first and second parameter responsive devices having pins movable along axes parallel to but spaced from each other, said pins engaging with tangs positioned at the ends of said first and second arms, said parameter responsive devices imparting pivotal movement to said lever in response to engine operating parameter changes, a pivot pin for mounting said lever, said pivot pin being slidable within a slot and is disposed between said axes, and a third arm of said lever being connected to said component and extending generally at right angles to said first and second arms, said slot being parallel to said third arm.

2. An apparatus according to claim 1 characterized in that said first engine operating parameter responsive device includes a piston slidable within a cylinder, resilient means biasing the piston towards one end of the cylinder, said piston being responsive to the outlet pressure of the low pressure pump.

3. An apparatus according to claim 1 characterized in that said second engine operating parameter responsive device comprises an air pressure responsive device responsive in use to the air pressure within the air inlet manifold of the associated engine.

4. An apparatus according to claim 1 characterized in that the length of the third arm is equal to the distance between said axes.

* * * * *